US005348081A

United States Patent [19]

Halstead et al.

[11] Patent Number: 5,348,081

[45] Date of Patent: Sep. 20, 1994

[54] HIGH CAPACITY AUTOMOTIVE CONDENSER

[75] Inventors: Gary A. Halstead; Brian L. Barten; Gregory R. Smith, all of Lockport, N.Y.

[73] Assignee: General Motors Corporation, Detroit, Mich.

[21] Appl. No.: 134,716

[22] Filed: Oct. 12, 1993

[51] Int. Cl.[5] ..... F28D 21/00

[52] U.S. Cl. ..... 165/144; 165/78; 165/153

[58] Field of Search ..... 165/78, 144, 153, 176

[56] References Cited

U.S. PATENT DOCUMENTS 5,000,257 3/1991 Shinmura ..... 165/140

5,009,262 4/1991 Halstead et al. ..... 165/140

FOREIGN PATENT DOCUMENTS 662841 4/1929 France ..... 165/144

*Primary Examiner*—John C. Fox

*Attorney, Agent, or Firm*—Patrick M. Griffin

[57] ABSTRACT

A high capacity condenser for automotive application is built up from two layers or modules so as to make maximum use of standard components. The tanks of header tank and tube type condensers are extruded with interfitting clearance notches and stand-off flanges along the length of the tanks that maintain the two modules spaced apart and aligned. A specially designed cross-over pipe interconnects the two modules in a fluid sense and also cooperates in mechanically joining the two.

2 Claims, 2 Drawing Sheets

HIGH CAPACITY AUTOMOTIVE CONDENSER

This invention relates to automotive air conditioner system condensers in general, and specifically to a high capacity condenser constructed in a modular fashion.

BACKGROUND OF THE INVENTION

Automotive air conditioning systems use a condenser, generally mounted in front of the radiator behind the grill, to dump heat from the system refrigerant after it has been warmed in an evaporator and compressed in a compressor. Older design condensers were generally of the serpentine fashion, having one or two long lengths of flat, extruded tubing wound back and forth in a sinuous pattern, or the tube and fin type, with a series of U-shaped, round tubes, the ends of which fed into manifolds.

A more recently adopted type of condenser is the tank and tube type of condenser, in which a pair of parallel, usually vertically mounted tanks serve as the manifolds at opposite ends of a plurality of relatively short, straight sections of tube. In one type of such condenser, the manifold tanks are basically cylindrical sections of pipe. The ends of the tubes run through slots in the pipes, so the width of the tubes, referred to often as the core width of the condenser, is comparable to the diameter of the pipe shaped tank. In another type of tank and tube condenser, the so called headered tank type, the tank is basically rectangular in cross section. Three of the four walls are generally flat or planar, provided by a channel shaped extrusion, while the fourth wall is provided by a slotted header plate crimped and brazed into the extrusion. The header plate is slotted to receive the ends of the tubes.

There are advantages and disadvantages unique to either design. The rectangular shape is, for equal wall thicknesses, inherently less resistant to bursting under pressure than is the round cross sectioned, cylindrical pipe. However, the rectangular tank is structurally better adapted to provide the manifold function. That is, the capacity of a condenser, its ability to dump heat, is directly related to the width of its tubes, sometimes called the core width. There must be a dimension in the manifold tanks large enough, when slotted, to receive the width of the tube ends. With a cylindrical manifold, it is the diameter of the pipe that must be large enough to accept the tube width, and the volume of the tank will go up with the square of the tube width. This translates into a lot of extra volume and size, volume not really needed for refrigerant capacity. With the rectangular tank, only the header plate (and opposed side wall) of the tank absolutely have to be widened to accept a wider tube. The face walls of the tank can remain the same size, so tank volume, theoretically, need only increase linearly with capacity, not with the square. As a practical matter, however, tank wall thickness will have to increase significantly to give sufficient burst pressure, with a wider tank, increasing tank weight and cost significantly. Of course, a larger tank means that all the components, tube, fin, tank extrusion, header plate, will be of a new and larger size, with obvious increases in tooling costs.

SUMMARY OF THE INVENTION

The invention provides an increased capacity condenser that is modular in nature, combining two or more substantially similar condenser modules, each built up from basically identical component parts.

Each of the two condenser modules has a pair of equally spaced, parallel tanks, rectangular cross section tanks each of which has at least one generally flat face wall and a side wall perpendicular thereto. A first of the condenser modules has a clearance notch of predetermined depth and width formed along the length of the tank face walls on at least one side, which is located at the juncture of the face wall and side wall, in the embodiment disclosed. The other condenser module also has a pair of tanks of similar size and shape, spaced apart similarly, and also having face walls opposable to those on the first module when the two modules are aligned. Those same face walls on the second module tanks are also each formed with a stand-off flange along their length which has a height slightly greater than the clearance notch depth, and which are inset from the tank sidewalls by less than the width of the clearance notch. Consequently, the two modules can be stacked or nested together, with respective stand-off flanges resting in respective clearance notches, thereby maintaining the opposed face walls slightly apart, with an enlarged gap between the respective pairs of side walls that is slightly more than twice the clearance notch depth. This allows the two modules to be mechanically joined, by brazing in the embodiment disclosed, at the areas of contact between the flanges and notches.

In order to operatively, hydraulically connect the two modules, a cross-over pipe is added on one side, between the opposed face walls of one tank pair. The cross-over pipe extends into and through the face walls and, in the embodiment disclosed, has a central barrel that is the same thickness as the enlarged gap referred to above, and which rests at least partially in the gap. Therefore, when the cross-over pipe is brazed in place, it also helps to mechanically join the modules, as well as providing a hydraulic juncture between the two. In operation, each tank has standard baffles that create a multipass through each module. At the end of the flow path in one module, the cross-over pipe sends the refrigerant to the other module. The capability thus exists to build an extra capacity, relatively compact condenser quite easily out of the same basic components used to make a standard condenser, with the addition of very few extra components and assembly steps.

DESCRIPTION OF THE PREFERRED EMBODIMENT

These and other features of the invention will appear from the following written description, and from the drawings, in which.

Figure 1:
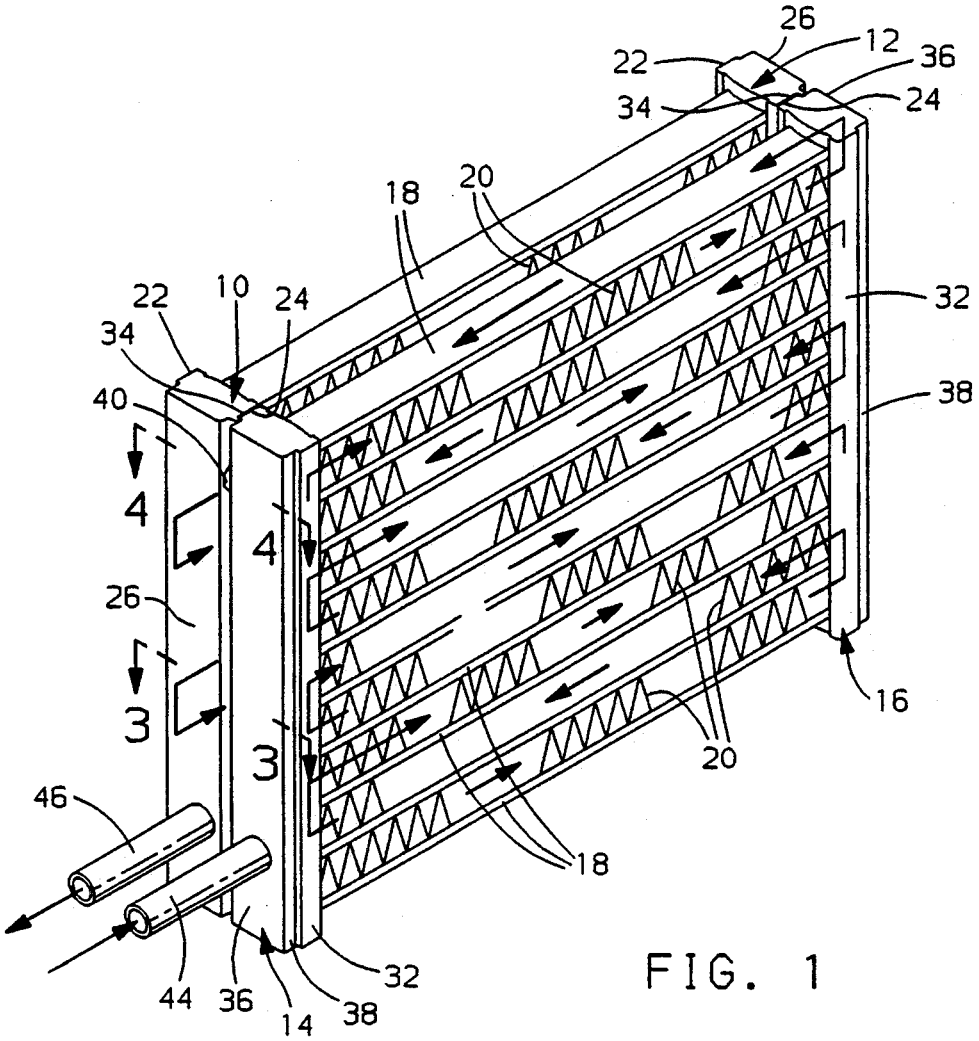
FIG. 1 is a perspective view of a preferred embodiment of a condenser according to the invention.

Referring first to FIG. 1, a preferred embodiment of the invention comprises two basic modules, each of which, in turn includes two parallel tanks, indicated generally at (10), (12), (14) and (16). Each pair of tanks (10), (12) and (14), (16) is interconnected, both mechanically and in a fluid sense, by a plurality of extruded aluminum tubes (18), each pair of which contains a cooling fin (20) therebetween. As in any condenser, the tubes (18) provide cooling passes for a refrigerant, and the fins (20) aid in conduction out of the tubes (18) as air is forced over them. The heat dumping capacity of any condenser is directly related to the capacity of the tubes (18), which is basically a function of the width of the tubes (18). Each tube (18) consists of a plurality of almost square, discrete passages, defined by continuous internal webs or ribs, not illustrated. These webs provide burst strength to the tube (18), and give it what could be considered an inherently modular construction per se. By that, it is meant that each separate passage operates independently, performing the same whether it is part of a tube with five such passages, or one twice as wide, with ten such passages. Making a condenser with twice as much capacity is, then, at least insofar as the width of tubes (18) is concerned, a simple matter of widening the tube, assuming its thickness stays the same. It is not so simple a matter for the tanks, however.

Figure 2:
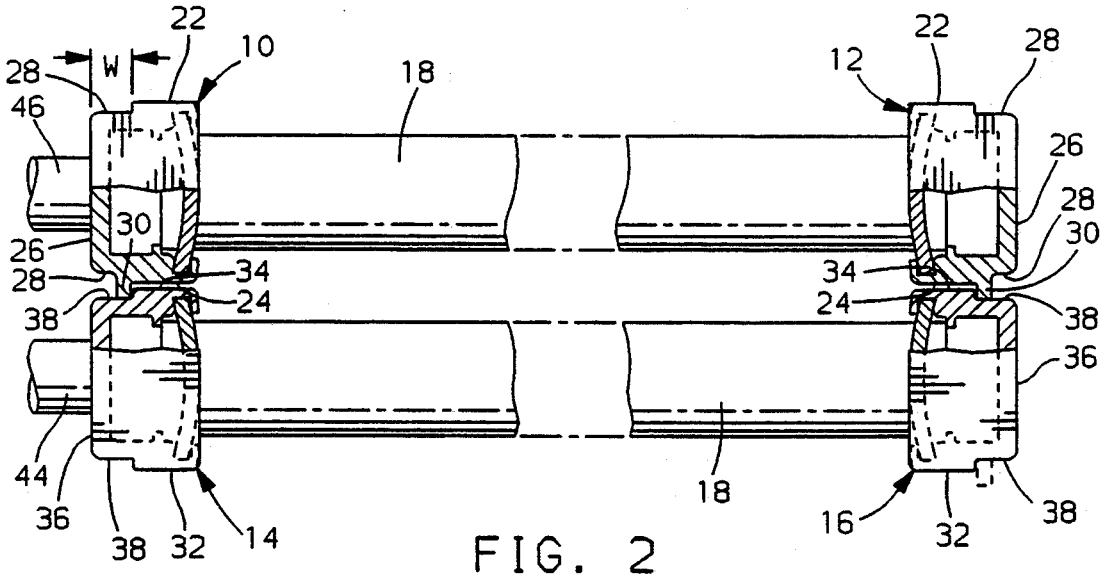
FIG. 2 is a top plan view of FIG. 1.
Figure 3:
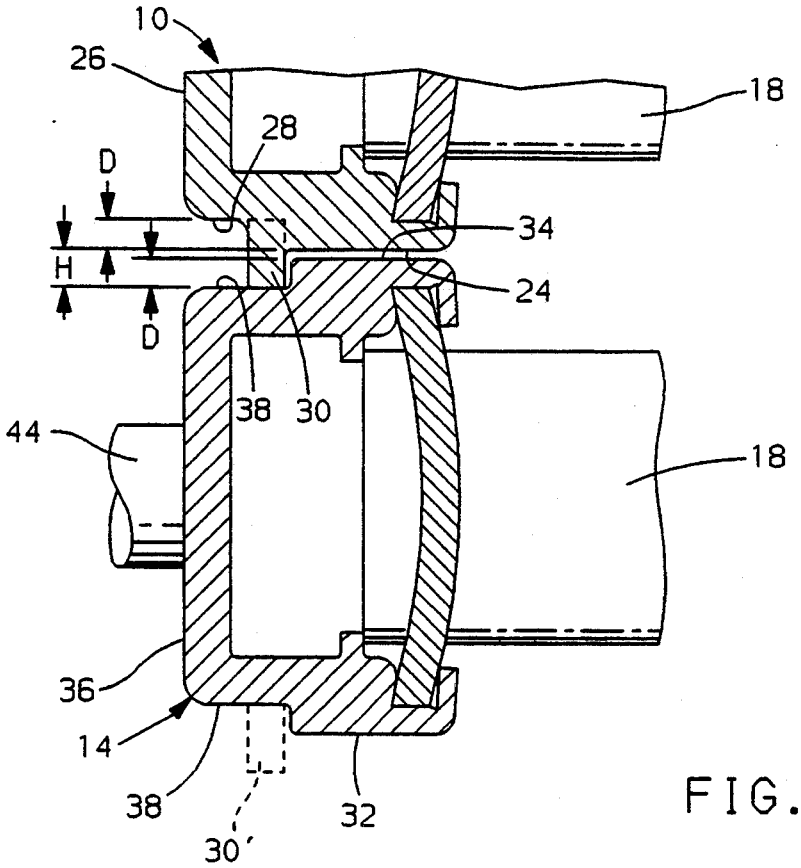
FIG. 3 is a cross sectional view of one side of the condenser taken along the line 3—3 of FIG. 1.

Referring next to FIGS. 2 and 3, details of the construction of the various tanks are illustrated. Each tank (10–16) is very similar, a basically rectangular cross section aluminum extrusion, and could be made exactly identical according to the invention. However, in the interest of clear description and of properly orienting the various surfaces, identical or nearly identical parts in the two modules are given unique numbers here. Tank (10), as well as tank (12), has three basically flat sides, including a pair of outer face walls (22), a pair of inner face walls (24), and a pair of side walls (26) perpendicular thereto. The face walls (22) and (24) each have a clearance notch (28) formed therein, at the corner juncture with side wall (26), of predetermined width 'W' and depth 'D'. The width of the clearance notch (28) that is adjacent to the interface of the inner face walls (24) and side walls (26) is obscured by a continuous stand-off flange (30), and the dotted corner line in FIG. 3 shows the portion of clearance notch (28) that is obscured by flange (30). Flange (30) has height H, measured relative to inner face wall (24), that is slightly greater than 'D', and which is inset from side wall (26) by less than 'W'. The tanks (14) and (16) are basically the same in construction, with a pair of outer face walls (32), a pair of inner face walls (34), and a pair of side walls (36) perpendicular thereto. The face walls (32) and (34) also each have a clearance notch (38) formed therein, at the corner juncture with side wall (36), of predetermined width 'W' and depth 'D'. There is no stand-off flange actually produced in the equivalent position for tanks (14) and (16), although one could be added, as shown by the dotted location marked (30').

Figure 4:
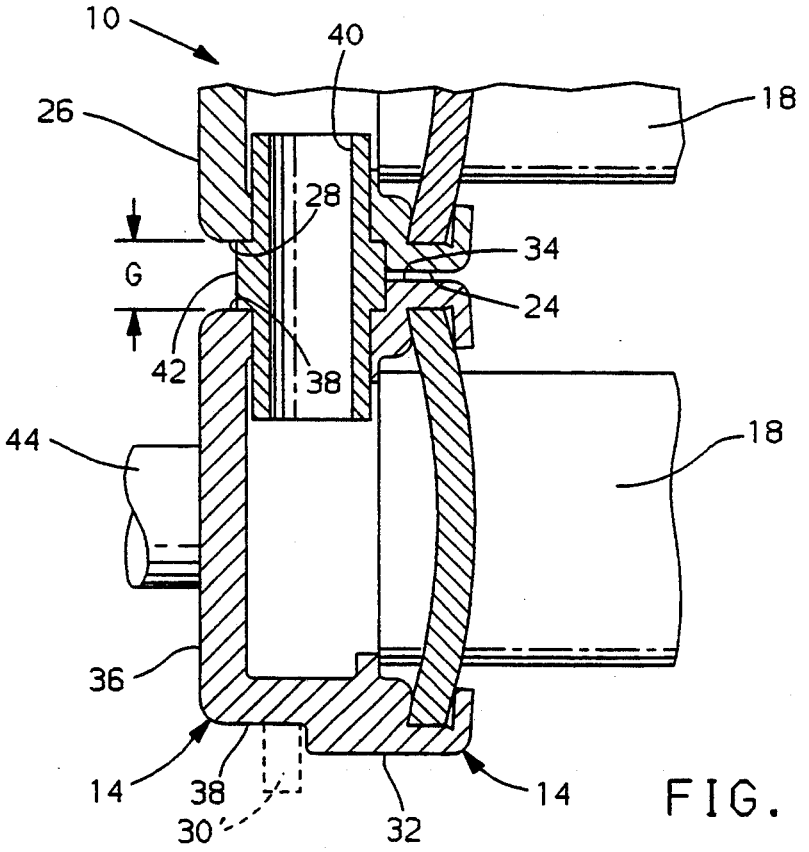
FIG. 4 is a cross sectional view of the same side of the condenser taken along the line 4—4 of FIG. 1.

Referring next to FIGS. 2 through 4, it may be seen how the construction of the component parts described above allows the tanks (10–16) to be assembled. The tanks (10) and (12) can be nested or stacked with the respective tanks (14) and (16), as two layers or modules. The inner face walls (24) and (34) are opposed to and facing one another, but held apart slightly due to the height of the stand-off flanges (30) sitting in the clearance notches (38). The two modules are prevented from shifting side-to-side to any significant degree, and are maintained square to one another, by the continuous, interfitting notches (38) and flanges (30). Since, in the ordinary course of assembling any condenser, the tubes (18) would be brazed into the tanks (10–16), the capability exists to apply a braze paste along the contact area between flange (30) and clearance notch (38), securing the two together rigidly. However, this would not, alone, serve to operationally connect the unit. To achieve this, a cross-over pipe, indicated generally at (40) is provided. Cross-over pipe (40), in the embodiment disclosed, has a symmetrical, stepped cylindrical shape with a central barrel (42) of wider diameter. As best seen in FIG. 4, there is a gap 'G' created between both of the pairs of respective tanks (10–16), tanks (10) and (14) being illustrated, that is slightly greater than twice 'D'. The axial thickness of barrel (42) is equal to 'G'. Before the brazing process described above, the opposed inner face walls (24) and (34) are drilled through at a selected location, toward the upper ends of the tanks (12) and (16) in the embodiment disclosed, so as to receive the two ends of pipe (40) therethrough. The barrel (42) sits closely within the gap 'G'. The same braze paste would be added to the contacting surfaces of barrel (42). In addition, an inlet fitting (44) is added near the lower end of tank (14), and an outlet fitting (46) similarly situated relative to tank (10). A series of conventional baffles, not separately illustrated, are also added at selected spaced locations inside the tanks (10–16). When the brazing operation is carried out, the two layers or modules may rest on a conveyer chain in the horizontal orientation shown in FIG. 2. During the brazing operation, gases created at the contact interface with the edge of the flanges (30) or the barrel (42) have a clear escape path through the clearance described above. All the components described become rigidly joined. The cross-over pipe (40), in addition to providing a fluid, operational connection between the tank pair (12), (16), also aids in the mechanical connection therebetween, through the barrel (42), which helps to maintain the gap 'G' and also provides more contact surface area around the ends of the pipe (40) to help prevent leaks.

Referring next to FIG. 1, the operation of the completed unit is illustrated. Refrigerant entering tank (14) through inlet fitting (44) flows through the first layer of tubes (18) in a serpentine fashion, as determined by the number and spacing of baffles chosen, until reaching the top of tank (16). From there, the top of tank (12) is reached through cross-over pipe (40), and a similar serpentine path is followed in reverse until outlet fitting (46) is reached at the lower end of tank (10). Thus, a condenser capacity substantially equivalent to a condenser with tubes twice as wide is achieved, with the same basic components, adding only the cross-over pipe (40). The burst strength of the tanks (10–16) is sufficient, because the side walls (26) have not been widened, as they would have to be if a single tank of twice the width were constructed. The modular assembly is almost as compact as a single unit of equivalent capacity would be, but for the spacing between the two layers of tubes (18). Conversely, a smaller condenser, one using just the tank pair (10) and (12), or (14) and (16), could be made with the same components, by moving the outlet fitting (46) to the other side.

Variations in the disclosed embodiment could be made. As already noted above, the tanks (14) and (16) could be extruded with a stand-off flange, giving complete interchangeability of parts. More layers could be conceivably joined than just the two, although it is unlikely that much capacity would be needed. The clearance notches need not be so wide as to take up the entire corner conjunction between the side walls and face walls. Theoretically, they need only be wide and deep enough to receive the stand-off flanges therein. However, it is easier to nest the stand-off flanges within the wider notches, and the larger gap 'G' so created is advantageous for receiving the barrel (42) of the particular cross-over pipe (40) disclosed. Likewise, a cross-over pipe without the barrel (42) would be adequate to simply provide a fluid connection between the two tanks (12) and (16). However, the barrel (42) provides the extra assurance of leak-free joining and cooperates in the mechanical interconnection of the modules, as described. Therefore, it will be understood that it is not intended to limit the invention to just the embodiment disclosed.

The embodiments of the invention in which an exclusive property or privilege is claimed are defined as follows:

1. A high capacity condenser for use in an automotive air conditioning system, comprising, a first and second condenser module, said first condenser module including a pair of parallel tanks that are generally rectangular in cross section, each of which tanks has at least one generally flat face wall, at least one of said face walls in each of said tanks also having a continuous clearance notch of predetermined depth formed therein along the length of said tank, said second condenser module also including a respective pair of similarly sized parallel tanks that are generally rectangular in cross section, each of which tanks also has at least one generally flat face wall opposed to said first module face walls and also including a stand-off flange along the length thereof and secured into said clearance notch and having a height slightly greater than said predetermined depth, so as to keep said pairs of opposed face walls slightly spaced apart, and, a cross-over pipe extending through one of said pairs of slightly spaced face walls so as to fluid connect one of said respective pairs of tanks, whereby refrigerant may enter one of said respective pair of tanks, run through one condenser module and then into the other module through said cross-over pipe.

2. A high capacity condenser for use in an automotive air conditioning system, comprising, a first and second condenser module, said first condenser module including a pair of parallel tanks that are generally rectangular in cross section, each of which tanks has at least one generally flat face wall and a side wall perpendicular thereto, at least one of said face walls in each of said tanks also having a continuous clearance notch of predetermined depth and width formed therein along the juncture of said face wall and side wall, said second condenser module also including a respective pair of similarly sized parallel tanks that are generally rectangular in cross section, each of which tanks also has at least one generally flat face wall and a side wall perpendicular thereto, at least one of said face walls in each of said tanks also having a continuous clearance notch of predetermined depth formed therein along the juncture of said face wall and side wall and further having a stand-off flange along the length thereof having a height slightly greater than said predetermined width and inset from the juncture of its respective face wall and side wall by less than said predetermined width, so as to nest with said clearance notches in said first module tanks and thereby, when secured thereto, keep said pairs of opposed faces walls spaced apart with an enlarged gap at the respective side walls of more than twice said predetermined width, and, a cross-over pipe having a central barrel equal in thickness to said gap and a pair of opposed sleeves extending through one of said pairs of slightly spaced face walls so as to fluid connect one of said respective pairs of tanks while cooperating with said flange to maintain said gap, whereby refrigerant may enter one of said respective pair of tanks, run through one condenser module and then into the other module through said cross over pipe.

* * * * *